United States Patent [19]

Pettingell

[11] Patent Number: 4,686,932

[45] Date of Patent: Aug. 18, 1987

[54] APPARATUS FOR APPLYING A MODIFYING INGREDIENT TO OPEN-CELLED POLYURETHANE MATERIAL

[75] Inventor: Winslow L. Pettingell, Rotonda West, Fla.

[73] Assignee: Foam Cutting Engineers, Inc., Addison, Ill.

[21] Appl. No.: 831,452

[22] Filed: Feb. 20, 1986

[51] Int. Cl.[4] ..... B05C 3/132

[52] U.S. Cl. ..... 118/419; 118/427; 100/258 R; 100/258 A; 100/176; 68/43

[58] Field of Search ..... 118/427, 419; 100/258 R, 258 A, 176, 161, 121; 68/43; 427/434.4

[56] References Cited

U.S. PATENT DOCUMENTS

| | | | |
|---|---|---|---|
| 554,266 | 2/1896 | Hagen et al. | 118/427 X |
| 3,096,708 | 7/1963 | Moser | 100/258 R X |
| 3,112,219 | 11/1963 | Politzer et al. | 427/434.4 X |
| 4,073,979 | 2/1978 | Pettingel | 427/244 |

*Primary Examiner*—John P. McIntosh

*Attorney, Agent, or Firm*—Wood, Dalton, Phillips, Mason & Rowe

[57] ABSTRACT

An apparatus for applying a modifying ingredient to a mass of open-celled polyurethane foam includes the application of an excess of a liquid solution or dispersion of the modifying ingredient to the mass of foam. A fixed frame mounts a plurality of spaced, generally parallel lower backing rollers. A movable frame is mounted above the fixed frame and carries a plurality of spaced, generally parallel pressure rollers for movement toward and away from the backing rollers. A first adjustment device is provided for lowering the movable frame to move the pressure rollers toward the backing rollers, with the mass sandwiched therebetween. A plurality of second adjustment devices are spaced at locations about the rollers for adjusting the pressure between the backing rollers and the pressure rollers uniformly along the rollers both in a direction transversely to and in the direction of movement of the mass through the rollers.

20 Claims, 4 Drawing Figures

APPARATUS FOR APPLYING A MODIFYING INGREDIENT TO OPEN-CELLED POLYURETHANE MATERIAL

BACKGROUND OF THE INVENTION

This invention generally relates to apparatus for modifying foamed plastic masses and, more particularly, to an apparatus for applying modifying ingredients to a mass of open celled polyurethane foam such as foam sheets.

Early methods for applying dyes, pigments and other modifying ingredients to open-celled polyurethane foam and other open-celled foams were based generally upon adhesion of the modifying ingredient to the surface of the foam, as by painting, or upon physical mixing of the modifying ingredient with the constituents prior the foam formation.

An improved method of applying modifying ingredients to open-celled polyurethane material is disclosed in my U.S. Pat. No. Re. 31,844 dated Mar. 5, 1985 (Reissue of U.S. Pat. No. 4,073,979 dated Feb. 14, 1978) which is assigned to the asignee of the present invention. In that improved method, the application of a modifying ingredient, such as a dye, pigment, color stabilizer or fire retardant, for example, contemplates applying an excess of a liquid solution or dispersion of the modifying ingredient to a mass of the foam, such as a foam sheet. A continuous strip of the sheet runs between opposed rollers in a tank of the liquid solution or dispersion whereat inhaling action takes place below the surface of the liquid so that there is little oppurtunity for the inhalation of air rather than the liquid. The continuous sheet then is fed through a set of squeeze rollers placed immediately after the dispersion dye tank where the sheet passes through a pressure nip between the rollers, the nip being tight enough to return most of the excess moisture to the liquid solution or dispersion tank. The pickup of shade from the dye is a function of the degree of squeeze between the rollers. Thereafter, the sheet is passed through a heating station which creates a suction to pass through gaseous material entirely through the mass containing the remainder of the liquid solution or dispersion to rapidly raise the temperature of the entire mass or sheet. The temperature is at least as high as the vaporization temperature of the liquid under the ambient condition of operation, and the period of exposure of the mass to the gaseous material is such that the liquid is vaporized and the modifying ingredient is effectively, simultaneously incorporated into the foam in a very short time.

The improved method described above has proven effective for modifying foam masses with various ingredients such as dyes, pigments, color stabilizers and fire retardants, including masses or sheets having a thickness greater than about 3/32 inch.

In such applications, the pressure applied by the rollers in the liquid solution or dispersion tank, some of which are driven, is not necessarily critical. On the other hand, it has been found that the prior art methods of applying modifying ingredients to such masses of open-celled polyurethane foam are ineffective when dealing with certain other modifying ingredients. For instance, if it is desirable to apply a modifying ingredient such as a highly soluble salt to a mass of open-celled polyurethane foam, extraordinary pressures are required while the mass or sheet is passed through the liquid solution or dispersion tank in order to pickup substantially all of the salt in the liquid solution. The problem is magnified when it is necessary to obtain uniform pickup either across the mass or continuous sheet or along the sheet. Conventional or previously known roller assemblies have proved inadequate for use with modifying ingredients such as soluble acid dyes or highly soluble salt, because they either are incapable of applying the large pressures necessary in the solution or dispersion tank or they do not apply sufficiently uniform pressures to obtain a uniform modification of the foam. In fact, it has been discovered that the amount of pickup of such modifying ingredients, such as highly soluble salts or acid dyes, is a function of the pressure applied to the mass in the liquid solution or dispersion tank.

This invention is directed to providing a new and improved apparatus for applying a modifying ingredient to a mass of open-celled polyurethane foam where high pressures are required for effective and uniform pickup of the modifying ingredient.

DESCRIPTION OF THE DRAWINGS

The features of this invention which are believed to be novel are set forth with particularity in the appended claims. The invention, together with its objects and the advantages thereof, may be best understood by reference to the following description taken in conjuntion with the accompanying drawings, in which like reference numerals identify like elements in the figures and in which:

DETAILED DESCRIPTION OF THE PREFERRED EMBODIMENT

Figure 1:
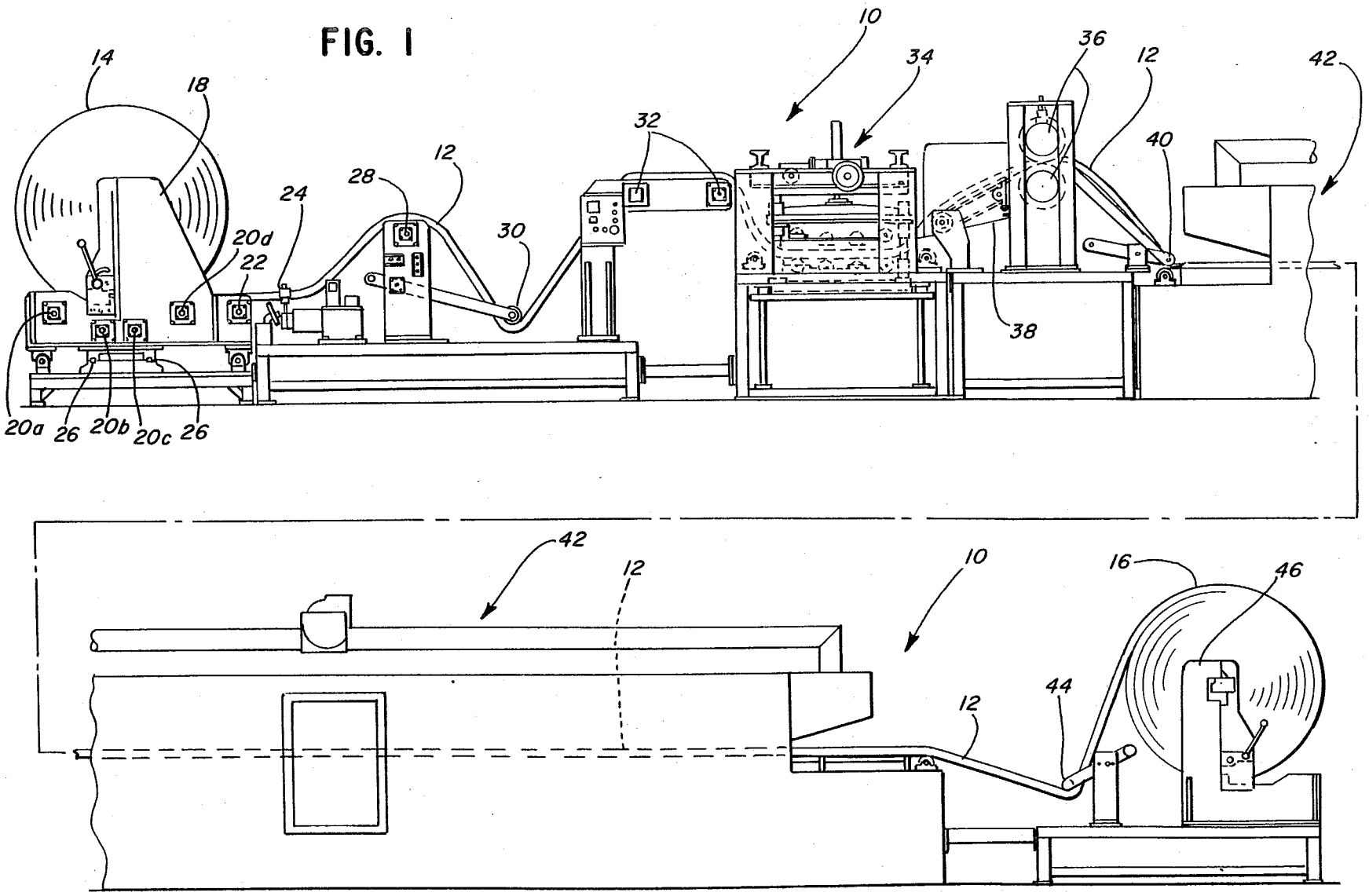
FIG. 1 is a side elevational view of a complete apparatus including the liquid dispersion tank and roller assembly of the invention.

Referring to the drawings in greater detail, and first to FIG. 1, a layout of an apparatus, generally designated 10, is illustrated, which applies a modifying ingredient to a mass of open-celled polyurethane foam. The mass is a sheet 12 of foam fed into the apparatus from a supply roll 14 at the front end of the apparatus. The processed foam sheet ultimately is wound onto a take-up roll 16 at the rear end of the apparatus. Supply roll 14 is disposed between opposed walls 18 and is supported on four rollers, the end brackets 20*a*,20*b*,20*c* and 20*d* thereof being visible in FIG. 1. The rollers supported by brackets 20*b* and 20*c* are driven.

From roll 14, foam sheet 12 passes over a roller represented by end bracket 22 and through fife jaws 24. The jaws sense the lateral position of foam sheet 12 and, through appropriate controls, move roll 14 on ball bearings 26 to center the roll and thereby center foam sheet 12.

The foam sheet then passes over a roller, represented by end bracket 28, and beneath a conventional dancing roller 30. Through appropriate controls, the dancing roller is effective to speed up or slow down the feeding of foam sheet 12 off of roll 14 to prevent the foam sheet from buckling as it flows through the apparatus. The foam sheet then passes over a pair of horizontally spaced rollers, represented by end brackets 32, and into a liquid dispersion bath or tank and roller assembly station, generally designated 34. This station incorporates the gist of the invention as will be described in greater detail hereinafter.

After excess liquid solution or dispersion is applied to the foam sheet at station 34, the foam sheets pass through the nip between a pair of driven pinch rollers 36 which remove the excess liquid. The excess liquid thus removed is returned to the tank at dispersion or solution station 34 by means of an inclined trough 38. The foam sheet which now has been applied with a modifying ingredient passes from pinch rollers 36 and beneath a second dancing roller 40 which, through appropriate controls, governs the driven speed of the pinch rollers.

The "modified" foam sheet then passes through an oven, generally designated 42, wherein the temperature of the polyurethane foam sheet is raised to a point to vaporize the liquid present in the liquid solution or dispersion. The heating process also accelerates the absorption of the modifying ingredient into the polyurethane to permanently incorporate the modifying ingredient into the foam. An example of a type of oven or heating apparatus is shown in my aforesaid U.S. Pat. No. Re. 31,844 which is incorporated herein by reference.

Lastly, foam sheet 12 passes from oven 42 beneath a third dancing roller 44 and onto takeup roll 16. The dancing roller, through appropriate controls, governs the speed of the takeup means journalled between walls 46.

As stated above, the invention resides in the dispersion bath and roller assembly station 34 which is shown in greater detail in FIGS. 2–4 which now will be described. Before proceeding, it should be reiterated that heretofore the pressures between the rollers in the liquid solution or dispersion bath were not of major concern, particularly when applying modifying ingredients such as dispersion dyes or pigments. However, it has been found that if a modifying ingredient such as highly soluble salt or a soluble acid dye is to be applied to the mass or sheet of open-celled polyurethane foam, extraordinary pressures are required, particularly if it is desirable to achieve substantially 100% pickup of the salt onto and into the polyurethane foam. For instance, pressures as high as twenty one tons may be required for effectively applying the liquid salt solution to a two-inch thick foam sheet, with the compressed thickness being on the order of 0.050 inch. A 1/16 inch thick foam sheet may be required on the order of nine tons of pressure, with a compressed thickness on the order of 0.0018 inch. If conventional roller assemblies heretofore known are used to exert such high pressures, it is practically impossible to accomplish uniformity of the modifying ingredient throughout the width and length of the foam sheet. In fact, the roller assemblies heretofore known would actually bend or warp under such loads, particularly if the pressure is applied at any single given location of the roller assembly. It is to these problems that the invention is directed.

Figure 2:
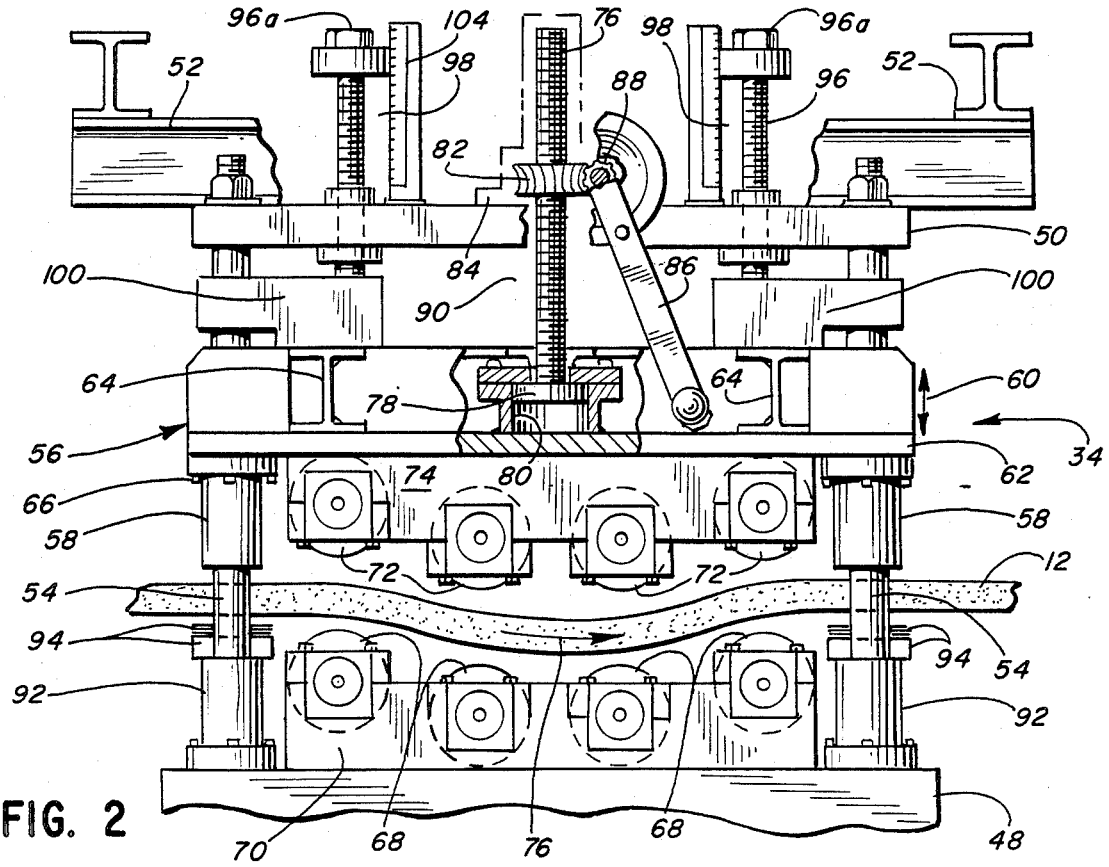
FIG. 2 is a fragmentary side elevational view, on an enlarged scale, of the roller assembly of the invention, with the pressure rollers and backing rollers separated.
Figure 4:
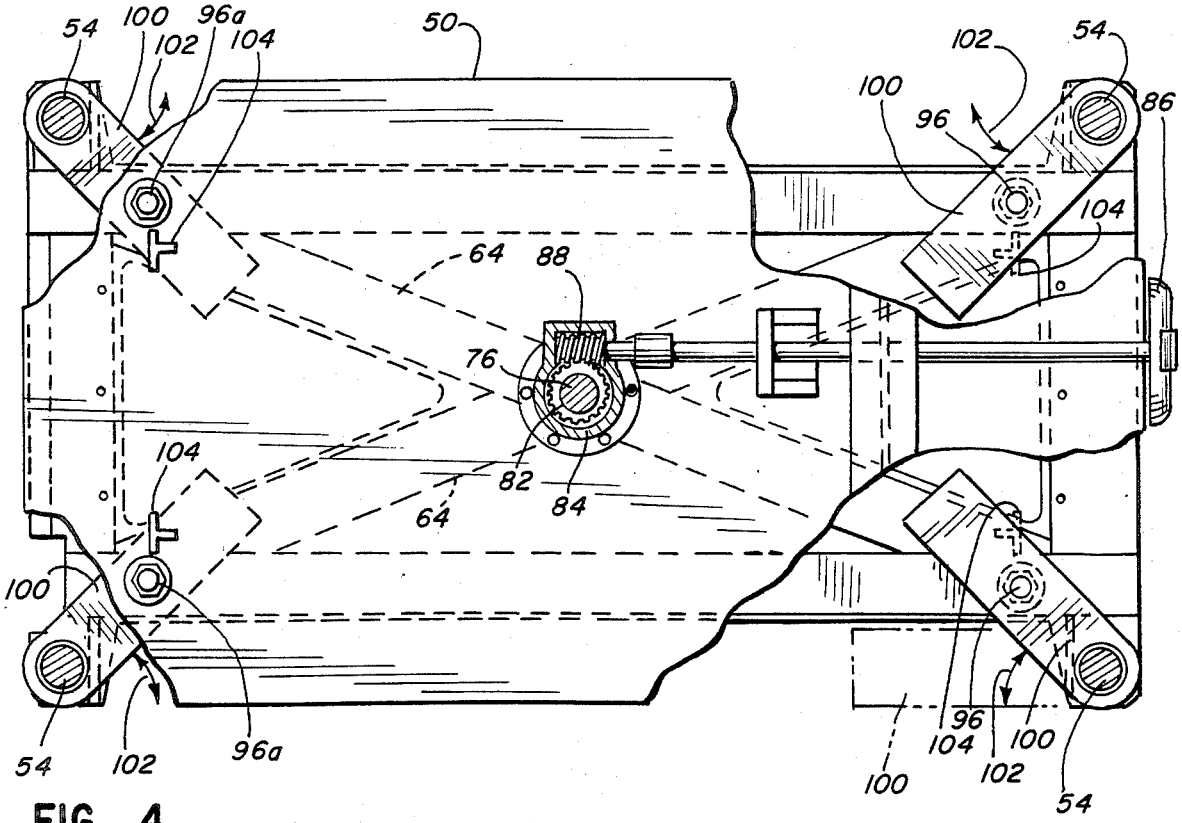
FIG. 4 is a top plan view of the roller assembly.
Figure 3:
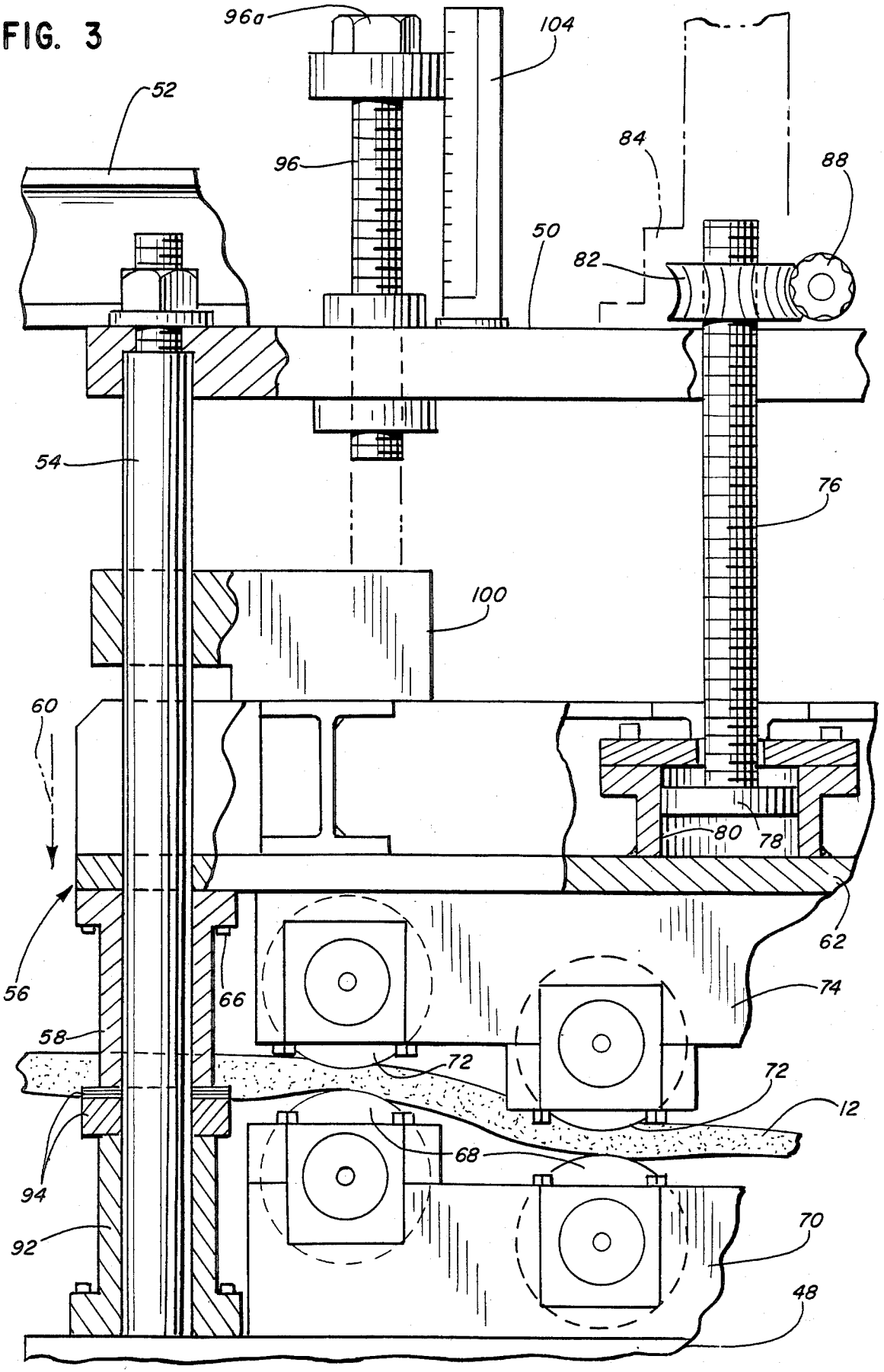
FIG. 3 is a fragmented side elevational view, on a further enlarged scale, of a portion of the roller assembly, with the rollers applying pressure to the foam mass.

More particularly, referring to FIGS. 2–4, liquid dispersion bath and roller assembly station 34 has fixed frame means including a fixed base 48 and an upper fixed plate 50 rigidly supported by overhead fixed frames 52. Four vertical guide posts 54 rigidly interconnect base 48 and upper plate 50 in vertically spaced disposition. The guide posts are located in a generally rectangular bounding orientation as best seen in FIG. 4.

Movable frame means, generally designated 56, are journalled by means of cylindrical sleeves 58 which surround guide posts 54 whereby the movable frame means can move in the direction of double-headed arrow 60 (FIG. 2). The movable frame means 56 is of substantial mass and substantial construction, and includes a horizontal support plate 62 which is fixed to and rigidified by substantial I-beams 64 above the plate. The I-beams are in a diagonally crossing configuration as shown in FIG. 4. Sleeves 58 are fixed to the underside of support plate 62 by means of bolts 66 whereby the sleeves depend from the underside of the support plate, surrounding guide posts 54, to guide the vertical movement of movable frame means 56 toward and away from fixed base 48.

Four elongated backing rollers 68 are journalled on and between end frame portions 70 fixed to and projecting upwardly from fixed base 48. Four elongated pressure rollers 72 are journalled on and between end frame portions 74 depending from the underside of support plate 62 of movable frame means 56. The rollers are solid in cross-section and may be as long as six feet. Pressure rollers 72 are driven by appropriate means, such as a chain and sprocket mechanism, for moving polyurethane foam sheet 12 between backing rollers 68 and pressure rollers 72, as indicated by arrow 76 (FIG. 2). Therefore, it can be seen that four sets of backing rollers 68 and pressure rollers 72 extend transversely across the path of foam sheet 12, with each set of rollers spaced longitudinally in the direction of movement of the foam sheet. It should be noted at this point that the bath or tank for containing the liquid solution or dispersion is not illustrated in FIGS. 1–4 so that all of the rollers are clearly illustrated. However, the bath is sufficiently deep so that the natural inhaling action of the foam sheet on the liquid solution or dispersion between the spaced sets of rollers takes place below the surface of the liquid. This is important so that there is no oppurtunity for the inhalation of air rather than the liquid.

First adjustment means are provided for moving movable frame means 56 and, therefore, pressure rollers 72 downwardly toward fixed rollers 68 to sandwich foam sheet therebetween. More particularly, a centrally located jack screw 76 passes through upper fixed frame plate 50 and includes an enlarged head 78 at the lower distal end thereof. The enlarged head is received within an enlarged socket 80 formed on the top of support plate 62 of the movable frame means. The jack screw is threaded through a gear 82 which is mounted within a bracket means 84 on the top of fixed frame plate 50. Gear 82 thereby can rotate relative to the jack screw but cannot move longitudinally relative thereto. A hand crank 86 is mounted on bracket means 84 and has a worm gear 88 on the inner distal end thereof in mesh with gear 82. Therefore, rotation of hand crank 86, through worm gear 88, causes rotation of gear 82 in a horizontal plane. Since jack screw 36 is threaded through gear 82, rotation of gear 82 effects longitudinal movement of the jack screw in the direction of double-headed arrow 90 (FIG. 2) to raise and lower movable frame means 56 and pressure rollers 72. Enlarged socket 80 provides a degree of lost motion of the movable frame means and pressure rollers when at their lower limit positions so that the substantial mass of the movable frame means applies initial pressure, by weight and gravity, onto the foam sheet which is sandwiched between backing rollers 68 and pressure rollers 72.

Cylindrical stop members 92 are fixed to base 48 and surround guide posts 54. A plurality of horseshoe shaped shims 94 may be selectively positioned between stop members 92 and sleeves 58 of movable frame means 56 to provide an initial increment of adjustment at the four corners of the roller assembly in order to achieve uniform roller gap thicknesses and, therefore, uniform pressures along the sets of rollers to thereby provide uniform application of the modifying ingredient to the foam sheet both transversely to and in the direction of movement of the sheet.

A plurality of second adjustment means are provided at spaced locations about the roller assembly for adjusting the pressure between backing rollers 68 and pressure rollers 72 uniformly along the sets of rollers both transversely to and in the direction of movement of foam sheet 12. More particularly, four posts 96 are threaded through upper fixed frame plate 50 and include upper polygonal heads **96*a* to facilitate rotating the posts and moving the posts vertically or longitudinally in the direction of double-headed arrows 98 (FIG. 2). By moving threaded posts 96 downwardly, the lower distal ends thereof can be used to apply pressure to the top of movable frame means 56 to finally apply and adjust the pressure between pressure rollers 72 and backing rollers 68. However, in order to reduce the length of threaded posts 96, spacer blocks 100 are provided for selective positioning between the respective lower distal ends of threaded posts 96 and the top of movable frame means 56, namely the tops of I-beams 64. These spacer blocks are journalled for pivoting movement about guide posts 54 in the direction of double-headed arrows 102 (FIG. 4) between positions (as shown) beneath threaded posts 96 to the position shown in phantom at the bottom, right-hand of FIG. 4 where the spacer blocks are out of the way of vertical movement of movable frame means 56 by jack screw 76. Lastly, micrometer means 104 are provided alongside threaded posts 96 for determining and/or recording the amount of pressure and/or adjustment accomplished by the second adjustment means comprising threaded posts 96**. It should be understood that although four locations are illustrated in the preferred embodiment for applying the final adjustment and pressure application, other locations are contemplated by the invention depending upon the numbers, orientation and other structural parameters of the roller assembly.

FIG. 2 shows movable frame means 56 in an elevated condition, with pressure rollers 72 spaced upwardly from backing rollers 68. In operation, once foam sheet 12 is properly threaded through the apparatus, an operator first will lower movable frame means 56 by rotating hand crank 86. Selective horseshoe shims 94 may have been positioned prior to lowering the movable frame means and pressure rollers. Final pressure and/or adjustment then is performed by selectively rotating threaded posts 96 after spacer blocks 100 have been moved into position beneath the threaded posts. It should be noted that the nips or gaps between the respective sets of rollers are shown exaggerated in FIG. 3 to facilitate the illustration. Gaps on the order of 0.0018 inch for 1/16 inch thick foam and 0.050 inch for two inch thick foam are typical in order to achieve the pressures required for modifying ingredients such as highly soluble salts.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting backing rollers means and movable frame means carrying pressure roller means for movement toward and away from the backing roller means, singular first adjustment means for moving the movable frame means and, thereby, the pressure roller means toward the backing roller means to sandwich the mass therebetween, and a plurality of second adjustment means at spaced locations about the roller means for adjusting the pressure between the backing roller means and the pressure roller means uniformly along the roller means.

2. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting a plurality of spaced, generally parallel backing rollers, movable frame means mounted above the fixed frame means and carrying a plurality of spaced, generally parallel pressure rollers for movement toward and away from the backing rollers, singular first adjustment means for lowering the movabe frame means to move the pressure rollers toward the backing rollers to sandwich the mass therebetween, and a plurality of second adjustment means at spaced locations about the roller means for adjusting the pressure between the backing roller means and the pressure roller means uniformly along the roller means.

3. The apparatus of claim 2 wherein said movable frame means is generally rectangular and including one of said second adjustment means near each corner thereof.

4. The apparatus of claim 2 wherein one of said second adjustment means is located near each end of each outside roller.

5. The apparatus of claim 2 wherein each said rollers are substantially solid in cross-section.

6. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting backing roller means and movable frame means carrying pressure roller means for movement toward and away from the backing roller means, first adjustment means located generally centrally of the roller means for moving the pressure roller means toward the backing roller means to sandwich the mass therebetween; and a plurality of second adjustment means at spaced locations about the roller means for adjusting the pressure between the backing roller means and the pressure roller means uniformly along the roller means.

7. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting backing roller means and movable frame means mounted above the fixed frame means and carrying pressure roller means for movement toward and away from the backing roller means, first adjustment means for lowering the movable frame means and, thereby, the pressure roller means toward the backing roller means to sandwich the mass therebetween, a plurality of second adjustment means at spaced locations about the roller means for adjusting the pressure between the backing roller means and the pressure roller means uniformly along the roller means, and vertical guide means for guiding movement of the movable frame means and pressure roller means.

8. The apparatus of claim 7 wherein said movable frame means is generally polygonal and said vertical guide means comprise telescoping post and sleeve means generally at the corners of the movable frame means.

9. The apparatus of claim 8 wherein one of said plurality of second adjustment means is located near each corner of the polygonal movable frame means.

10. The apparatus of claim 9 wherein each said second adjustment means includes vertically adjustable post means movable generally parallel to the vertical guide means.

11. The apparatus of claim 10 wherein said vertically adjustable post means is threaded into a fixed frame portion above the movable frame means for applying downward biasing pressure on the movable frame means.

12. The apparatus of claim 11, including spacer means selectively positionable betweeen the lower distal end of said vertically adjustable post means and the movable frame means to accomodate initial adjustment by said first adjustment means.

13. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting a plurality of spaced, generally parallel backing rollers, movable frame means mounted above the fixed frame means and carrying a plurality of spaced, generally parallel pressure rollers for movement toward and away from the backing rollers, first adjustment means for lowering the movable frame means to move the pressure rollers toward the backing rollers to sandwich the mass therebetween, and a plurality of second adjustment means at spaced locations about the roller means for adjusting the pressure between the backing rollers and the pressure rollers uniformly along the roller, said second adjustment means including vertically adjustable post means threaded into a fixed frame portion above the movable frame means for applying downward biasing pressure on the movable frame means.

14. The apparatus of claim 13, including spacer means selectively positionable between the lower distal end of said vertically adjustable post means and the movable frame means to accomodate initial adjustment by said first adjustment means.

15. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting a plurality of spaced, generally parallel backing rollers, movable frame means mounted above the fixed frame means and carrying a plurality of spaced, generally parallel pressure rollers for movement toward and away from the backing rollers, first adjustment means located generally centrally of the plurality of rollers for lowering the movable frame means to move the pressure rollers toward the backing rollers to sandwich the mass therebetween, and a plurality of second adjustment means at spaced locations about the roller means for adjusting the pressure between the backing rollers and the pressure rollers uniformly along the rollers.

16. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting a plurality of spaced, generally parallel backing rollers, movable frame means mounted above the fixed frame means and carrying a plurality of spaced, generally parallel pressure rollers for movement toward and away from the backing rollers, first adjustment means for lowering the movable frame means to move the pressure rollers toward the backing rollers to sandwich the mass therebetween, a plurality of second adjustment means at spaced locations about the roller means for adjusting the pressure between the backing rollers and the pressure rollers uniformly along the rollers, and vertical guide means for guiding movement of the movable frame means and pressure rollers.

17. The apparatus of claim 16 wherein said movable frame means is generally polygonal and said vertical guide means comprise telescoping post and sleeve means generally at the corners of the movable frame means.

18. The apparatus of claim 17 wherein one of said plurality of second adjustment means is located near each corner of the polygonal movable frame means.

19. The apparatus of claim 18 wherein each said second adjustment means includes vertically adjustable post means movable generally parallel to the vertical guide means.

20. An apparatus for applying a modifying ingredient to a mass of open-celled polyurethane foam, comprising:

means for applying an excess of a liquid solution or dispersion of said modifying ingredient to the mass of foam; and means for squeezing the mass to remove most of the excess liquid, including fixed frame means mounting a plurality of spaced, generally parallel backing rollers, movable frame means mounted above the fixed frame means and carrying a plurality of spaced, generally parallel pressure rollers for movement toward and away from the backing rollers, first adjustment means for lowering the movable frame means to move the pressure rollers toward the backing rollers to sandwich the mass therebetween, a plurality of second adjustment means at spaced locations about the roller means for adjusting the pressure between the backing rollers and the pressure rollers uniformly along the rollers, said second adjustment means including vertically adjustable post means for applying downward biasing pressure on the movable frame means, and linear micrometer means alongside each said vertically adjustable post means.

* * * * *